United States Patent [19]

Oser

[11] Patent Number: 4,712,498

[45] Date of Patent: Dec. 15, 1987

[54] MULTIPLE SUPPORT BAR FOR MANIPULATION OF A HAND-HELD SAIL ASSEMBLY

[75] Inventor: Richard B. Oser, Houston, Tex.

[73] Assignee: New Ocean Wind Products, Inc., Houston, Tex.

[21] Appl. No.: 920,462

[22] Filed: Oct. 20, 1986

Related U.S. Application Data

[63] Continuation-in-part of Ser. No. 864,824, May 19, 1986.

[51] Int. Cl.[4] ..... B63H 9/04

[52] U.S. Cl. ..... 114/39.2; 441/75; 182/3

[58] Field of Search ..... 114/39.2; 182/3, 4, 182/8, 9; 441/75

[56] References Cited

U.S. PATENT DOCUMENTS 606,400 6/1898 Whitner ..... 182/4
4,121,822 10/1978 DiSabatino et al. ..... 182/3
4,474,261 10/1984 Mader ..... 182/3

FOREIGN PATENT DOCUMENTS 2115684 9/1983 United Kingdom ..... 182/3

*Primary Examiner*—Joseph F. Peters, Jr.
*Assistant Examiner*—Thomas J. Brahan
*Attorney, Agent, or Firm*—Neal J. Mosely

[57] ABSTRACT

A versatile, lightweight bar is shown, with multiple places for attachment, to be worn in conjunction with a sailboarding harness, which is fastened to the sail assembly of a sailboard to support a person during sailing. The bar consists of two or more connecting members attached to a rigid curved bar which is, in turn, fastened to the straps of a conventional body harness in the preferred embodiment. The connecting members hook onto the harness lines of the boom to support the person's weight, thereby decreasing forearm fatigue and stress to the hands. The support bar with the spaced apart connecting members has the advantage of allowing significant control of the sail assembly using body movements rather than the arms or hands.

17 Claims, 6 Drawing Figures

FIG. 1A
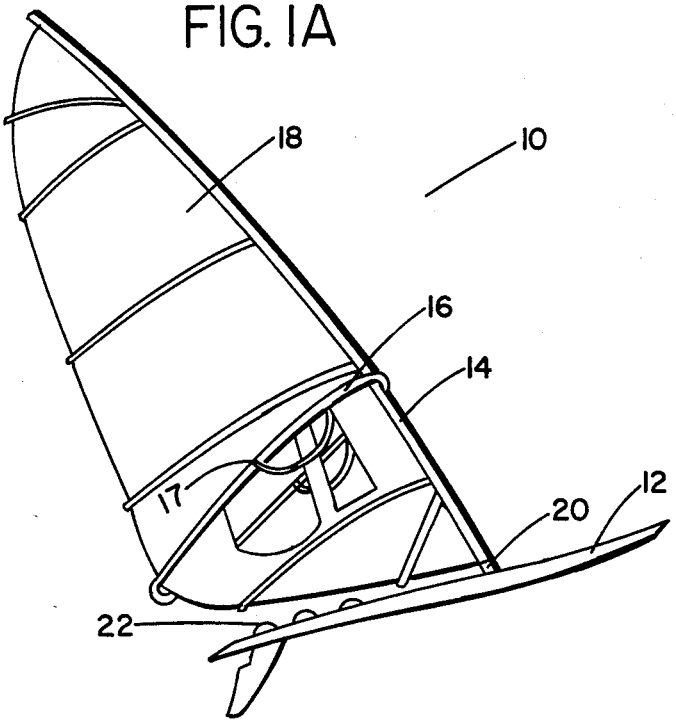
FIG. 2
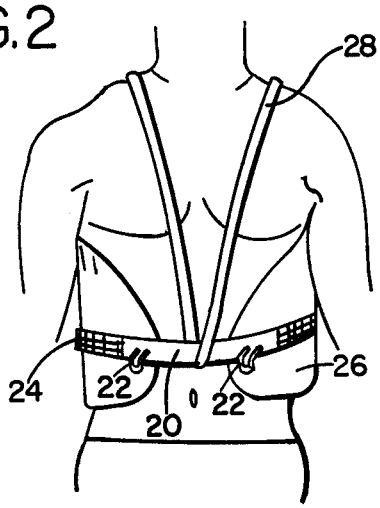
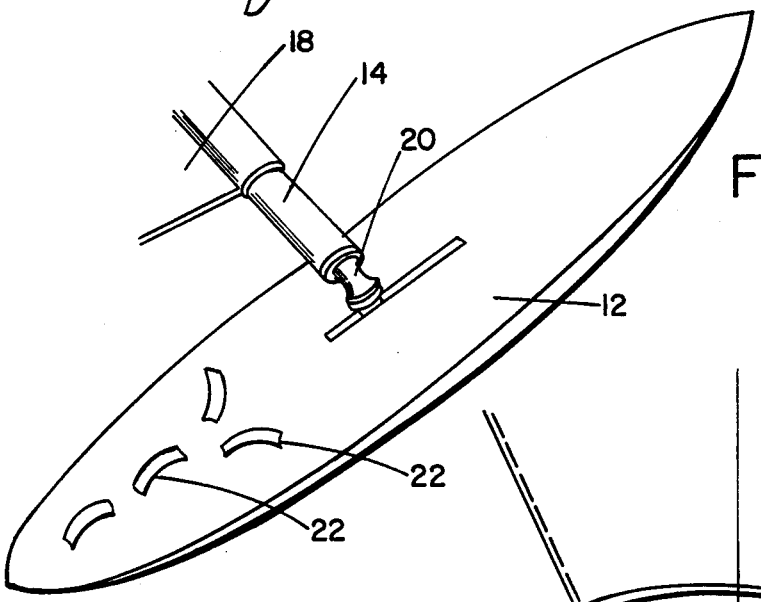
FIG. 1B
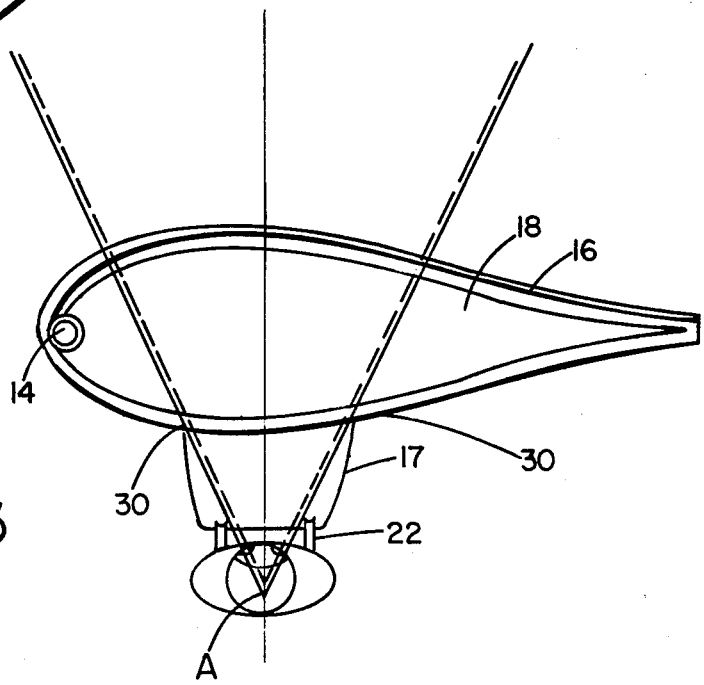
FIG. 3

FIG. 4A
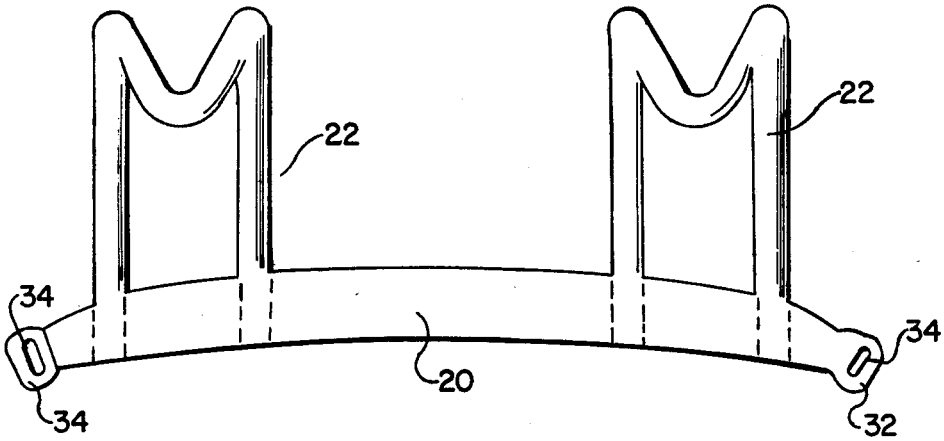
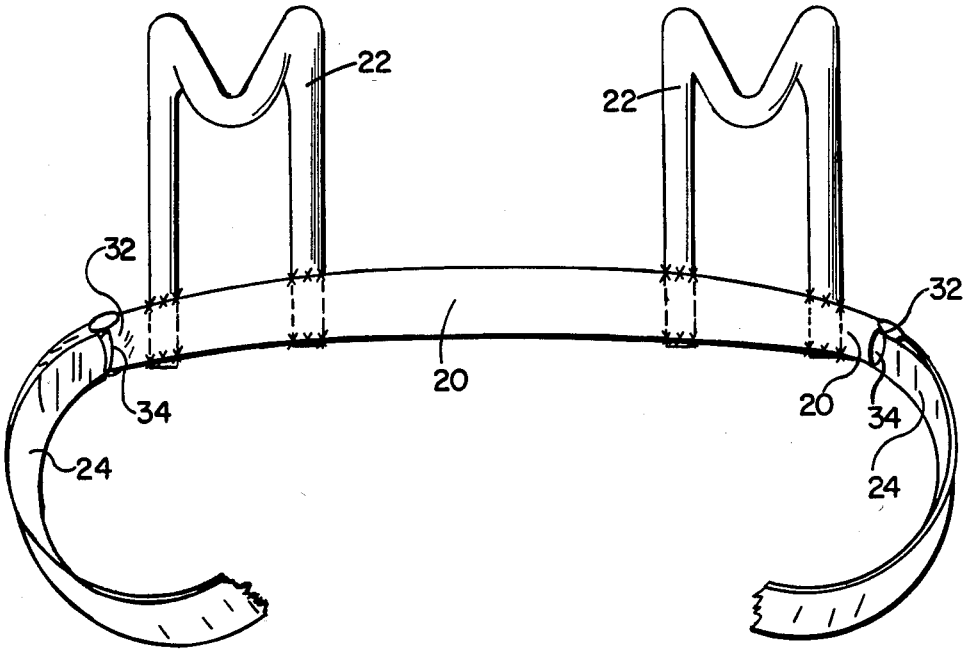
FIG. 4B

MULTIPLE SUPPORT BAR FOR MANIPULATION OF A HAND-HELD SAIL ASSEMBLY

CROSS REFERENCE TO RELATED PATENT APPLICATION

This application is a continuation-in-part of U.S. patent application Ser. No. 864,824 filed May 19, 1986, by R. Barry Oser entitled "Harness for Supporting a Person During Sailboarding."

BACKGROUND OF THE INVENTION

Field of the Invention

This invention relates to new and useful improvements in sailing harness fastening members and, more particularly, to a means for relieving fatigue of the hands and allowing direct body manipulation of a hand-held sail assembly.

Sailboarding is a water sport using a board and sail assembly attached a universal joint to the board, as shown in FIG. 1. The board ranges in length from six to twelve feet. The sail is rigged with fifteen to sixteen foot mast and a boom which holds the sail in place. The mast, sail and boom are attached to the board by a universal joint. The sailor positions himself on the board and manipulates the boom to transfer the power of the wind to the board for speed.

Sailboarding requires continuous muscular effort which limits the duration of participation in the sport. Many different types of harnesses are known which can be worn while sailing. These harnesses fall into two categories: one, body harnesses which encompass the torso or waist and attach to the sail assembly via a single connecting element such as rope; and two, "traction arrangements", a wrist or hand attachment which is detachable connected to the sailing assembly by a frictional connection or a hand-held flexible, solid element which is deformable about the boom using hand pressure.

One example of a body harness known as "the harness" is a jacket-like nylon garment with a hook or fastening member located on the chest or lower torso which is secured to a rope or line attached to the boom. The "harness" was first designed approximately 12 to 18 years ago to provide support for the sailor and decrease the stress on the sailor's arms.

The harness is secured to the boom line by means of a single, central hook. The problem with the single hook is that it changes the power and feel of the sail to the center of the body, not the arms or sides of the body. This does not allow the sailor to adjust as accurately or quickly as when the hands hold the boom and control the majority of the sail assembly's power.

Other examples of body harnesses used to secure the sailor to the sailboard are described by U.S. Pat. Nos. 4,112,865 to Carn, 4,058,045 to Spanier, and 4,505,216 to Elorza.

Carn, U.S. Pat. No. 4,112,865, discloses a harness with an adjustable chest belt and shoulder straps and a releasable connector attached to a cord secured to the sailboard apparatus, for example, the tackle.

Spanier, U.S. Pat. No. 4,058,845, discloses a sailing harness which has a strap or connector which surrounds the sailor's buttocks, and elastic straps which secure an attachment connector around the shoulders and chest. The attachment connector is then secured to the sail assembly.

Elorza, U.S. Pat. No. 4,505,216, discloses an elongated, flexible piece which is secured at each end to one side of the boom of a sailboard. The sailor positions himself between the boom and the flexible piece so that he can lean back on the piece.

McCoy, U.S. Pat. No. 4,516,295, discloses a variation of conventional "harness lines" which attaches a conventional body harness to the boom of a sailboard. The improvement taught by this patent is a releasably adjustable, pliable member which tightens around the boom when tension is applied to the rope.

Burger, U.S. Pat. No. 4,235,182, discloses apparatus for securing a sailor to a sailboard boom by use of attachments for a harness which goes around the sailor's chest and shoulders. The apparatus includes deformable connectors secured by the sailor's hands to the boom and released when the sailor moves his hands. This traction arrangement solves the previously discussed problem by allowing free body movement but creates a new problem altogether by restricting movement of the hands. It is very important for a sailor to have free use of hands for technical sailing maneuvers without interference of any kind from the harness or traction arrangement.

U.S. patent application, Ser. No. 864,824, filed May 19, 1986, by applicant entitled "Harness for Supporting a Person During Sailboarding", discloses a harness for supporting a person during sailboarding which is based on the concept that the sailor needs to maintain control of the sail assembly during sailboarding while at the same time having a means for reducing strain on the sailor over an extended period of time. This was achieved by the use of support harnesses which secured the forearms of the sailor to the sail assembly. The drawback to this invention is the relatively complicated nature of the harnesses.

SUMMARY OF THE INVENTION

One of the objects of this invention is to provide an apparatus used in wind sailboarding which creates a direct relationship between the body and the sail assembly with an improved ability to control the sail assembly without strain on the arms and hands.

A further object of the invention is to provide a means for securing the sailor to the sail assembly of a wind sailboard which is both strong and safe, particularly with respect to release in case of an emergency.

Another object of the invention to provide such an apparatus which is economical, versatile, and can be used with existing sailboarding harnesses.

Other objects of the invention will become apparent from time to time throughout the specification and claims as hereinafter related.

The foregoing objects and other objects of the invention provide for a method and apparatus for releasably, safely securing a person to a sailboard which allows direct control of the sail assembly through a body harness while at the same time relieving stress on the sailor's hands.

The support bar of the invention comprises a rigid, curved bar having multiple spaced connectors which is positioned across the width of the sailor's body for connection to a line or lines secured to the sail assembly. In the preferred embodiment, two hooks are located at opposite ends of the bar. Loops or slotted end connectors are located at each end of the curved bar for attachment to the straps of presently available sailboarding harnesses or to a separate webbed belt. The curved bar, spaced connectors and loops or slotted end connectors are made of a strong, stiff corrosion-resistant material such as metal or plastic.

BRIEF DESCRIPTION OF THE DRAWINGS

FIG. 1*a* is a drawing of a sailboard;

FIG. 1*b* is the mast and universal joint connection of the sailboard of FIG. 1*a;*

FIG. 2 is a plan view of a sailor wearing a harness and support bar according to the present invention;

FIG. 3 is a top view of a sailor using a support bar according to the present invention;

FIGS. 4*a* and *b* are side views of the support bar with connectors and belt ends according to the present invention.

DESCRIPTION OF A PREFERRED EMBODIMENT OF THE INVENTION

This invention is a method and apparatus for use in wind sailboarding. The apparatus comprises a rigid, curved support bar secured to a sailing harness worn by a sailor with multiple connectors for attachment to the harness of the sail assembly of a sailboard. The support bar secures the sailor safely to the sail assembly and allows control of the sail assembly through movement of the body while at the same time relieving stress on the sailor's hands which would otherwise limit the duration of his sailing time.

A conventional sailboard 10 is shown in FIG. 1*a*. The sailboard 10 consists of a board 12, mast 14, boom 16 extending outwardly from the mast 14, harness lines 17, sail 18 which is secured to the boom 14, and a universal joint 20 connected at the base of the mast 14 to the board 12. As further shown in FIG. 1*b*, the universal joint 20 allows the mast 14 to pivot about the board 12 according to the movements of the sailor (no shown). The sailor positions his feet within footholds 22 on the board 12 to help maintain his position during sailing.

As mentioned above, sailboarding requires continuous muscular effort which limits the duration of participation in the sport. Many different types of harnesses are known which can be worn while sailing. These harnesses fall into two categories: one, body harnesses which encompass the torso or waist and attach to the sail assembly via a single connecting element such as rope; and two, "traction arrangements", a wrist or hand attachment which is detachable connected to the sailing asembly by a frictional connection or a hand-held flexible, solid element which is deformable about the boom using hand pressure.

One example of a body harness known as "the harness" is a jacket-like nylon garment with a hook or fastening member located on the chest or lower torso which is secured to a rope or line attached to the boom. The harness is secured to the boom line by means of a single, central hook. The problem with the single hook is that it changes the power and feel of the sail to the center of the body, not the arms or sides of the body. This does not allow the sailor to adjust as accurately or quickly as when the hands hold the boom and control the majority of the sail assembly's power.

U.S. patent application, Ser. No. 864,824, filed May 19, 1986 by applicant, entitled "Harness for Supporting a Person During Sailboarding", discloses a harness for supporting a person during sailboarding which is based on the concept that the sailor needs to maintain control of the sail assembly during sailboarding while at the same time having a means for reducing strain on the sailor over an extended period of time. This was achieved by the use of support harnesses which secured the forearms of the sailor to the sail assembly. The drawback to this invention is the relatively complicated nature of the harnesses.

The present invention is based on the concept that multiple points of attachment of the sailor to the sail assembly allow the sailor greater control than the previously available body harnesses with a single point of attachment. None of the other apparatus have more than a single point of attachment to the sail assembly, with the exception of those which require actual placement of the hands on or around the sail assembly. The single point of attachment does not provide a means for controlling the boom with the body since it acts only as a pivotal point of attachment. By avoiding the hands, long-term muscle strain of the sailor is still avoided.

As shown in FIG. 2, a preferred embodiment includes a rigid, curved bar 20 having multiple connecting members 22, which is secured to the front of the sailor's torso by a belt 24. In the preferred embodiment, the bar 20 is fitted over a conventional sailboarding harness 26. The straps of the harness around the lower chest function as belt 24, and the bar 20 is held in place vertically by strap 28 of the harness.

As shown in FIG. 3, the sailor attaches the connecting members 22 to the harness lines 17. As shown, the preferred number of connectors 22 is two although additional connectors 22 could be positioned across the bar 20 as desired for further control. The connectors 22 are welded to or molded as part of bar 20 so that a rigid frame is provided which curves around the front of the sailor's torso.

In FIGS. 4*a* and 4*b*, the multiple connectors 22 are positioned at each end of the curved bar 20. The preferred configuration and location of the connectors 22 is such that they are located at the outer portions of the sailor's torso when the bar 20 is strapped around his torso and secured by end connectors 32, either connecting the ends of bar 20 to the straps of a conventional harness (FIG. 4*a*) or a separate belt 24 (FIG. 4*b*). The end connectors 32 are of conventional construction and may be made of a variety of materials in any number of configuration. In the preferred embodiment, shown in FIG. 4*a*, the end connectors 32 are of aluminum or other metal welded to the bar 20, and have a slot or opening 34 for securing the bar 20 to the belt 24 or straps of a conventional body harness.

OPERATION

In use, the sailor secures the body harness on his torso. The support bar 20 is to the harness at each end by the straps or belt 26. The connectors 22 are located on each end of the bar-like member 20 to increase sail control with the use of the sailor's body leverage and body movements. The connectors 22 are fitted over the harness line 17 which are attached to balance points 30 on the boom 16. To attach the apparatus to the sail assembly, the sailor must pull sail assembly to body and allow the harness line to hook onto the connectors 22 of the embodiment.

The rigid framework of the support bar 20 and multiple connectors 22 then provide the sailor with leverage over boom 16 with consequent control of the mast 14 and sail 18 using simple body movements. The sail responds parallel to body movement thus allowing the sail and sailor to work together in harmony without necessarily using hands. Once hooked-in, the sailor can release hand pressure and let the body control sail assembly; for example: twist body clockwise and sail will follow clockwise on a radius to body positioning. To detach from sail assembly, sailor pulls, with hands, sail assembly to body to release harness line pressure from connecting elements.

Although this invention has been described with reference to specific embodiments, it will be evident that modifications and variations may be employed by those skilled in the art. It is intended that all such modifications and variations be included within the scope of the appended claims.

I claim:

1. An apparatus for securing a sailor to a sailboarding assembly comprising a sailboard, mast, boom and sail, and having a harness line connected at each end to said boom, said apparatus comprising;

a rigid bar member adapted to be secured circumferentially around the front portion of a sailor's torso;

a plurality of open hook members spaced along said bar member, extending generally perpendicularly from and rigidly fixed to said bar member for connecting said bar member to the sailing assembly;

means for securing said bar member on the sailor's torso; and said open hook members being adapted to be connected to said harness line at spaced points thereon to provide connections from multiple points on the sailor's torso to the sailing assembly whereby movements of the multiple hook members transmit movement from two points on the bar member to two points on the harness line for manipulation of said sailing assembly by body movements.

2. The apparatus of claim 1 wherein said bar member securing means comprises end slot connectors for connection to straps on body harness worn by the sailor.

3. The apparatus of claim 2 wherein said bar member, connectors, and end connectors are made of a material selected from the group consisting of aluminum, stainless steel, and plastic.

4. The apparatus of claim 1 wherein said connectors comprise at least three hook members extending generally perpendicularly from and rigidly fixed to said bar member, one being centrally located and the other two being adjacent to each end thereof.

5. The apparatus of claim 1 wherein said bar member is constructed of a lightweight, rigid, chemically-resistant tubing.

6. The apparatus of claim 1 further comprising a flexible, strong, lightweight and chemically-resistant belt, wherein said bar member is secured around the sailor's torso by means of the belt attached to the end connectors.

7. The apparatus of claim 1 wherein said end connectors for securing the bar member are slotted and said bar member is adapted to be secured by the straps of a sailboarding harness.

8. An apparatus for securing a sailor to a sailboarding assembly comprising a sailboard, mast, boom and sail, and having a harness line connected at each end to said boom, said apparatus comprising;

a vest-like harness having means for securing the same to the torso of a sailor and including side straps for securing a sailing harness bar member thereon, a rigid bar member fitting circumferentially around the front portion of a sailor's torso when secured to said vest-like harness;

a plurality of connectors spaced along said bar member for connecting said bar member to the sailing assembly;

means for securing said bar member to said side straps of said vest-like harness, and said connectors being open hook members being adapted to be connected to said harness line at spaced points thereon to provide connections from multiple points on the sailor's torso to the sailing assembly whereby movements of the multiple hook members transmit movement from two points on the bar member to two points on the harness line for manipulation of said sailing assembly by body movements.

9. The apparatus of claim 8 wherein said bar member securing means comprises end slot connectors for connection to said side straps.

10. The apparatus of claim 9 wherein said bar member, connectors, and end connectors are made of a material selected from the group consisting of aluminum, stainless steel, and plastic.

11. The apparatus of claim 8 wherein said connectors are hook members extending generally perpendicularly from and rigidly fixed to said bar member adjacent to each end thereof.

12. The apparatus of claim 8 wherein said connectors comprise at least three hook members extending generally perpendicularly from and rigidly fixed to said bar member, one being centrally located and the other two being adjacent to each end thereof.

13. The apparatus of claim 8 wherein said bar member is constructed of a lightweight, rigid, chemically-resistant tubing.

14. The apparatus of claim 8 further comprising a flexible, strong, lightweight and chemically-resistant belt, wherein said bar member is secured around the sailor's torso by means of the belt attached to the end connectors.

15. The apparatus of claim 8 wherein said end connectors for securing the bar member are slotted and said bar member is adapted to be secured by the straps of a sailboarding harness.

16. A method for sailing a sailboarding assembly comprising a sailboard, mast, boom and sail, and having a harness line connected at each end to said boom, said method comprising;

providing a rigid bar member adapted to be secured circumferentially around the front portion of a sailor's torso;

said bar member having a plurality of spaced open hook members extending generally perpendicularly from and rigidly fixed to said bar member for connection to the sailing assembly, and means for securing said bar member on the sailor's torso; and securing said bar member on the sailor's torso, positioning said sailboarding assembly in a body of water for sailing, positioning the sailor on said sailboard, connecting said bar member open hook members to said harness line at spaced points thereon to provide connections from multiple points on the sailor's torso to the sailing assembly, and manipulating the boom and sail to direct movement of said sailboard by inward and outward, sidewise, and twisting movements of the harness line by corresponding movements of the body of the sailor, whereby movements of the multiple hook members transmit movement from two points on the bar member to two points on the harness line.

17. The method of claim 16 further including the steps of providing a vest-like harness having means for securing the same to the torso of a sailor and including side straps for securing said sailing harness bar member thereon, securing said vest-like harness on the torso of the sailor, said bar member securing means comprising end slot connectors for connection to said body harness side straps, and securing said bar member to said vest-like harness by connecting said side straps to said end slot connectors.

* * * * *